US006277809B1

(12) United States Patent
Obama

(10) Patent No.: US 6,277,809 B1
(45) Date of Patent: Aug. 21, 2001

(54) RESIN GRANULE FOR WASHING, METHOD FOR PRODUCING THE SAME, AND METHOD FOR WASHING RESIN MOLDER USING THE SAME

(76) Inventor: Kenjiro Obama, 17-8, Sakuradai 3-chome, Ichihara-shi, Chiba (JP)

( * ) Notice: Subject to any disclaimer, the term of this patent is extended or adjusted under 35 U.S.C. 154(b) by 0 days.

(21) Appl. No.: 09/275,428

(22) Filed: Mar. 24, 1999

(30) Foreign Application Priority Data

Mar. 24, 1998 (JP) ..... 10-095437

(51) Int. Cl.[7] ..... C11D 17/00

(52) U.S. Cl. ..... 510/438; 510/188; 510/193; 510/219; 510/441; 510/445; 510/446

(58) Field of Search ..... 510/193, 219, 510/244, 438, 441, 445, 446, 188

(56) References Cited

U.S. PATENT DOCUMENTS

| | | | | |
|---|---|---|---|---|
| 4,731,126 | * | 3/1988 | Dixit et al. | 134/38 |
| 4,838,945 | * | 6/1989 | Fujii et al. | 134/7 |
| 4,954,545 | * | 9/1990 | Bailey | 524/158 |
| 5,087,653 | * | 2/1992 | Obama et al. | 524/158 |
| 5,108,645 | * | 4/1992 | Obama et al. | 252/174.23 |
| 5,124,383 | * | 6/1992 | Obama et al. | 524/115 |
| 5,238,608 | * | 8/1993 | Obama et al. | 252/535 |
| 5,397,498 | * | 3/1995 | Ishida et al. | 252/174.23 |
| 5,443,768 | * | 8/1995 | Scheibelhoffer et al. | 264/39 |
| 5,556,572 | * | 9/1996 | Nishinaka et al. | 510/188 |

FOREIGN PATENT DOCUMENTS

| | | | |
|---|---|---|---|
| 237954A | | 12/1983 | (JP) . |
| 60130698 | * | 7/1985 | (JP) . |

* cited by examiner

*Primary Examiner*—Cynthia Harris
*Assistant Examiner*—Dawn L. Garrett
(74) *Attorney, Agent, or Firm*—Venable; Marina V. Schneller

(57) ABSTRACT

The resin granule of the present invention for washing comprises a resin granule, a detergent component and, optionally, a third component, wherein the external surface of each particle of the resin granule is coated with the detergent component. The method for producing the resin granule for washing, comprising a resin granule, a detergent component and, optionally, a third component brings the resin granule into contact with the detergent component for a sufficient time so that the external surface of the former is coated with the latter by at least one of the processes selected from the group consisting of:

(a) immersion of the resin granule in a solution of the detergent component, (b) spraying a solution of the detergent component onto the resin granule, (c) mixing the resin granule with a solution of the detergent component under no heating, and (d) adsorption of the detergent component vapor on the external surface of the resin granule, and then separates the resin granule coated with the detergent component. The method for washing resin molders using the above resin granule for washing is also provided.

8 Claims, No Drawings

RESIN GRANULE FOR WASHING, METHOD FOR PRODUCING THE SAME, AND METHOD FOR WASHING RESIN MOLDER USING THE SAME

FIELD OF THE INVENTION

This invention relates to a resin granule used for washing, a method for producing the same and a method for washing resin molders or the like using the same. More particularly, the invention relates to granules consisting of resin particles, each of which is coated with a detergent component on the surface. Such granules showing excellent ability to wash a molder, e.g., injection molder or extruder, when the color or type of resin it molds is to be changed, requiring only a short time and a small quantity for any type of resin. The invention also relates to a method for producing such granules by coating the particles of the granule with a coating component by an adequate method, e.g., immersion of the particles in the coating solution, spraying the coating solution onto the particles, adsorption of the coating component on the particles. The invention also relates to a method for washing molders or the like using the same.

BACKGROUND OF THE INVENTION

In molding synthetic resin by an injection molder or extruder, the molder is washed when type of resin it molds is to be changed, with the resin that will next be molded to remove the residues of the preceding resin. However, washing a molder by such a method takes a long time, needs large quantities of wash resin, and cannot completely wash complex structures within the molder, with the result that the molded articles of the subsequent resin may be discolored, and their qualities, such astransparency, degraded.

It is very important for molding synthetic resin to reduce the quantity of wash resin and the washing time for a molder, when color or type of resin it molds is to be changed, in order to maintain or improve productivity.

In order to solve the above problems, detergents of thermoplastic resin compositions, incorporated with a detergent component, have been developed, and are used to clean a molder when type of resin it molds is changed.

For example, Japanese Laid-open Patent Application No. 124046/1993 discloses a resin composition for washing molders that mold thermoplastic resins, which comprises (a) a thermoplastic resin incorporated with (b) 1 to 20 wt. % of a sulfonic acid-based surfactant, (c) 1 to 30 wt. % of an inorganic salt or metallic hydroxide having water of crystallization, starting to be dehydrated at 100° C. or higher [e.g., $Al(OH)_3$], (d) 1 to 20 wt. % of an inorganic filler. Japanese Patent Publication No. 78557/1994 discloses a resin composition for washing molders, which comprises (A) a thermoplastic resin incorporated with (B) factice, (C) slip additive and (D) non-ionic surfactant.

However, the methods for producing these compositions involve problems. For example, it is disclosed that the method for producing the former composition mixes a molten thermoplastic resin with one or more essential components and auxiliary components, also molten, by a kneader such as monoaxial or biaxial extruder. As a result, each particle of the composition contains the detergent component deep inside. For the latter composition, it is disclosed that the thermoplastic resin A is mixed with the other components A to D by a tumbler or high-speed mixer and the mixture is kneaded by an extruder. These detergents proposed so far have been produced by the methods, which fall into the category of kneading.

As described above, these detergents contain a detergent component dispersed inside the detergent particles. As a result, it takes a long time for the detergent component to diffuse to the particle surface during the washing step, even though large quantities of the expensive component being incorporated into the resin. It covers only part of the particle surface, even when it diffuses to the surface. Use of such a detergent needs a long washing time and a large quantity of the resin to be molded subsequently. Therefore, there is increased need for a detergent that can avoid these problems.

BRIEF SUMMARY OF THE INVENTION

It is the objects of the present invention to provide a resin granule which is able to wash molders, e.g., injection molder and extruder, in a shorter time and in a smaller quantity than is currently available, to provide a method for efficiently producing the same, and also to provide a method for washing resin molders or the like using the same.

The applicants of the present invention have found, after extensively studying to solve the above problems involved in the conventional detergents for washing injection molder and extruder, that the above problems can be solved by the use of resin granule whose particles are coated thinly with a detergent component on the surface, reaching the present invention.

The first objective of the present invention is to provide a resin granule for washing molders or the like, which is composed of resin particles and a detergent component, wherein each of the resin particles is covered with the detergent component on the surface.

The second objective of the present invention is to provide a method for producing the resin granule for washing molders or the like, wherein the resin granule is brought into contact with the detergent component for a sufficient time so that the external surface of the former is coated with the latter by at least one of the processes selected from the group consisting of:

(a) immersion of the resin granule in a solution of the detergent component, (b) spraying a solution of the detergent component onto the resin granule, (c) mixing the resin granule with a solution of the detergent component under no heating, and (d) adsorption of the detergent component vapor on the external surface of the resin granule, and then the resin granule coated with the detergent component is separated.

The third objective of the present invention is to provide a method for washing resin molders or the like using the above resin granule.

DETAILED DESCRIPTION OF THE INVENTION

The present invention is described concretely, below.

The resin granule of the present invention for washing molders or the like is composed of resin particles and a detergent component, wherein the external surface of each particle is coated with the detergent component. The resin granule is produced by a mixer/kneader, and the granule can take a variety of shapes, e.g., spherical, cylindrical, angular, marble-like, sheet-like and flaky. The type of resin for the resin granule is not limited, and can be thermoplastic or thermosetting. Concretely, the resin useful for the present invention includes, but is not limited to, polyolefins, e.g., high-density polyethylene, low-density polyethylene, straight-chain, low-density polyethylene, polypropylene, polybutene and polymethyl pentene; styrene-based resins, e.g., polystyrene, acrylonitrile-butadiene-styrene (ABS) resin, acrylonitrile-styrene (AS) resin, methyl methacrylate-styrene (MS) resin, and methyl methacrylate-butadiene-styrene (MBS) resin; acryl-based resins, e.g., methyl polymethacrylate (PMMA) and polyacrylonitrile (PAN); vinyl-based resins, e.g., polyvinyl chloride, polyvinyl acetate and polyvinylidene chloride; and EPDM, methyl ethylene methacrylate (EMMA), polyamide, polyacetal (POM), polycarbonate (PC), polyphenylene ether (PPE), polyphenylene sulfide (PPS), polyethylene terephthalate (PETP), polybutylene terephthalate (PBTP), polyether imide (PEI), polyetheretherketone (PEEK), fluorine-based resins, silicon-based resins, epoxy resins and decomposable resins. They can be used individually or in combination. The resin granule may be powdery or pellets of relatively large size. It can be produced by cutting, e.g., sheet-cut, strand-cut, hot cut in air or hot cut in water using a kneading device, e.g., monoaxial or multi-axial extruder, continuous mixer, Banbury mixer, internal mixer, Co-kneader, high-pressure kneader, or open two-roll device. Size of the granule is not limited, the efficient size for the present invention being 0.5 to 10 mm on the average, preferably 1 to 5 mm, as the longest dimension of each particle. It is particularly preferable that the particles have a specific size distribution for washing complex structures in a molder. The efficient particle size distribution for the present invention is particles of 10 mm or more in size accounting for 5% or less and those of 0.5 mm or less in size accounting for 5% or less, all based on the whole particles.

One of the novel characteristics of the resin granule of the present invention is that the detergent component is present essentially in the coating layer over the external surface of each particle of the resin granule. Thickness of the coating layer of the detergent component is 100$\mu$ or less, preferably 1 m$\mu$ to 100$\mu$, more preferably 2 m$\mu$ to 70$\mu$, most preferably 5 m$\mu$ to 30$\mu$ for securing sufficient washing effect. When thickness of the coating layer of the detergent component is below 1 m$\mu$, the detergent cannot fully exhibit its inherent effect for washing a molder when the type of resin it molds is to be changed, as illustrated by COMPARATIVE EXAMPLES, later described. When the thickness of the coating layer is above 100 $\mu$m, on the other hand, other types of problems may occur; e.g., the washing effect may no longer increase in proportion to quantity of the detergent component used, and there may be increased difficulty in handling the detergent because of its increased adhesion. Thickness of the coating layer can be determined by the elliptical polarization method ("Surface Measurement Techniques and Their Applications," pp. 102, published by Kyoritu Shuppan).

The resin granule of the present invention for washing molders or the like can achieve the washing effect by a very small quantity of the detergent component, because it does not appreciably penetrate deep inside of the particles. It is concentrated on the particle surface area to directly act on the molder being washed, the improved washing effect brought about thereby being another advantage of the present invention.

The detergent component of the resin granule of the present invention for washing molders or the like is not limited, so long as it is a liquid, having a solubility parameter (SP) of 10 or less, preferably 8 or less. Particularly preferable detergent components for the present invention are enumerated below.

These include liquid aliphatic hydrocarbons, aliphatic fluorine compounds, surfactants (e.g., hydrocarbon-, fluorine- and silicone-based ones), lubricant oils (e.g., paraffinic, naphthenic and aromatic ones), other process oils and extenders, synthetic oils (e.g., hydrocarbon-based oligomers), fluorine oils, silicone oils, polyethylene glycol, trimethylol propane, pentaerythritol, polyols, and inorganic silicones. These can be used individually or in combination. Their SP values may be determined by the procedure shown in "Adhesives Handbook" (edited by Adhesion Society of Japan, 1980, 2nd edition, pp. 17).

Any type of a surfactant may be used. For example, anionic, cationic, non-ionic or ampholitic surfactants are used. According to kinds of hydrophobic groups of surfactants, these surfactants are classified to hydrocarbon- and fluorine-based surfactants. The fluorine-based surfactants include perfluoroalkyl carboxylate, perfluoroalkyl sulfonate, perfluoroalkyltrimethyl ammonium salt, perfluoroalkyl ethylene oxide adduct, perfluoroalkyl amineoxide, perfluoroalkyl oligomer, perfluoroalkyl betaine perfluoroalkyl aminosulfonate, etc.

The resin granule of the present invention for washing molders or the like may be incorporated with a third component, in addition to the above detergent component, in order to further improve its washing effect. The third component useful for the present invention includes lubricants, inorganic materials, surfactants and surface modifiers. It may be in any form under normal conditions, e.g., powdery, liquid or solid. More concretely, it includes hydrocarbon-based lubricants (e.g., paraffins and chlorinated paraffins), higher alcohols (e.g., stearyl alcohol and cetyl alcohol), fatty acid-based lubricants (e.g., stearic acid and oleic acid), ester-based lubricants (e.g., butyl stearate, glycerine monostearate, ethylene glycol monostearate), metallic soap-based lubricants (e.g., magnesium stearate, basic fatty acid magnesium and calcium stearate), fatty acid amide-based lubricants (e.g., ethylene bis-stearic acid amide, ethylene bis-stearoamide derivatives of high softening temperature and oleic acid amide), ether-based lubricants (e.g., polypropyleneglycol alkyl ethers), high-molecular-weight lubricants (e.g., polyolefin wax, and methyl methacrylate (MMA)/alkyl acrylate copolymer), silicone-based lubricants (e.g., silicone powder and silicone resin), fluorine-based lubricants, polytetrafluoroethylene, and other lubricants (e.g., vinylidene fluoride/hexafluoropylene copolymer).

Inorganic materials useful as the third component for the present invention include aluminum hydroxide, calcium carbonate, basic magnesium carbonate, zinc borate and glass.

Surfactants useful for the present invention include powdery, liquid or solid anionic, cationic, non-ionic and ampholitic surfactants. Preferable ones are organosilicon-, organoboron- and fluorine-based surfactants.

Surface modifiers useful for the present invention includes perfluoroalkyl acrylate and silane coupling agents.

The third component can be attached to the external surface of the resin particle, after being mixed with the detergent component, in a manner similar to that used for the detergent component alone. It is preferably attached to the detergent component already covering the particles, but it may be kneaded with the resin granule, which is then coated with the detergent component. The ratio of the third component to the detergent component may be 1:1 to 1:20 by weight, preferably 1:10 to 1:15.

Next, the method of the present invention for producing the resin granule is described. This method is not limited, other methods, such as one of skill in the art could readily devise, are acceptable so long as they coat the external surface of the resin granule with the detergent component. The resin granule can be produced by the following methods. The solution of the detergent component, described in this specification, includes not only a homogeneous solution but also suspension.

The resin granule is brought into contact with the detergent component for a sufficient time so that the external surface of the former is coated with the latter by at least one of the processes selected from the group consisting of:

(a) immersion of the resin granule in a solution of the detergent component, (b) spraying a solution of the detergent component onto the resin granule, (c) mixing the resin granule with a solution of the detergent component without heating, and (d) adsorption of the detergent component vapor onto the external surface of the resin granule, and then the resin granule, coated with the detergent component, is separated.

In process (a) above, the mixture of the detergent component in the impregnation solution may be a solution or suspension with water or an organic compound as the solvent. Content of the detergent component is not limited, but normally in a range from 1 to 30%, preferably 1 to 5%. Organic solvents, useful for the present invention, include normal hexane and isopropyl alcohol. The resin granules may be immersed in the solution at normal temperature. Impregnation of the third component may be effected in a manner similar to that for the detergent component.

Process (b) atomizes or sprays a solution of the detergent component onto the resin granule. Concentration of the solution is not limited, but is normally in a range from 1 to 30%. It may be sprayed at normal temperature.

Process (c) mixes the resin granule with a solution of the detergent component under no heating, e.g., at normal temperature, by an adequate means, e.g., mixer.

Process (d) heats the detergent component to form a vapor, which is brought into contact with the resin granule. This condition is held until the external surface of the resin granule is deposited and coated with the detergent component. More concretely, the deposition condition is not limited, and optionally selected. For example, the resin granule can be mixed with the volatile detergent component, which is evaporated over the resin granule by heat of the reaction to cover the external surface.

Each of the above processes (a) to (d) can produce, by a simple procedure, the detergent achieves its high washing effect more efficiently with much smaller quantities of the detergent component than the conventional method of kneading.

The coating layer of the detergent component over the resin granule may be left wet, but preferably it is solidified and strengthened by heating at low temperature, where the coated resin granule is held at approximately 20 to 150° C., preferably approximately at 30 to 120° C. for 1 min to 2 h, preferably 2 min to 1 h. This heat treatment can prevent rapid exfoliation of the detergent component and hence improve stability of the washing effect.

The method of the present invention for washing resin molders is for various resin molders, e.g., injection molders and extruders. Concretely, the resin granule for washing is charged into a molder from its hopper or vent inlet, bringing it into contact with the inner walls while heating the contents at a temperature higher than melting point of the resin inside, to wash the walls by the measurement-injection or measurement-extrusion procedure.

Illustrative Embodiments

The preferred embodiments of the present invention are described, below:

1 A polyethylene resin granule for washing molders or the like, wherein the external surface of each particle of the granule is coated with a detergent component to a thickness of 10 mμ to 30μ, 2 a polyethylene resin granule for washing molders or the like, wherein the external surface of each particle of the granule is coated with a detergent component and a third component to a thickness of 15 mμ to 50μ, 3 a polypropylene resin granule for washing molders or the like, wherein the external surface of each particle of the granule is coated with a detergent component to a thickness of 10 mμ to 30μ, 4 a polypropylene resin granule for washing molders or the like, wherein the external surface of each particle of the granule is coated with a detergent component and a third component to a thickness of 15 mμ to 50μ, 5 a method for producing a resin granule for washing molders or the like, wherein the resin granule is immersed in a solution of a detergent component for a sufficient time so that a 1 mμ to 100μ thick coating layer is formed over the particles of the resin granule, and the resin particles coated with the detergent component are dried, and 6 a method for producing a resin granule for washing molders or the like, wherein the resin granule is immersed in a solution of a detergent component for a sufficient time so that a 1 mμ to 100μ thick coating layer is formed over the particles of the resin granule, ethylene bis-stearic acid amide as the third component is attached to the resin particles coated with the detergent component, and the resin particles thus treated are dried.

EXAMPLES

The present invention is described more concretely by EXAMPLES and COMPARATIVE EXAMPLES, which by no means limit the present invention.

The resins, detergents and methods for evaluating the washing effect and the like used for EXAMPLES are described below.

Resins: The following commercial resins were used:

| | |
|---|---|
| ABS | Mitubishi Chemical, Tufrex TFX-420 |
| ABS (transparent grade) | Japan Synthetic Rubber, JSR ABS 59 |
| ABS (flame-retarded grade) | Mitubishi Chemical, Tufrex TFX-SH |
| PPE | GE Plastics, Japan, Noryl SE90 |
| PP | Sumitomo Chemical, Noblen H501 |
| PP (transparent grade) | Sumitomo Chemical, Noblen WP834A |
| PS | Mitubishi Chemical, Diarex DIX-CK |
| PC | Teijin Chemicals, Panlite K-1300 |

Detergent 1

The high-density polyethylene granule used as the detergent was prepared by the following procedure:

A high-density polyethylene granule (melt index MI=0.35, determined in accordance with JIS K-7210) was monoaxially extruded under the conditions of cylinder temperature of 200° C. and sheet die temperature of 210° C., and cut by sheet-cutting into the high-density polyethylene particles.

Detergent 2

The polypropylene granule used as the detergent was prepared by the following procedure. A polypropylene granule (MI=0.5, determined in accordance with JIS K-7210) was monoaxially extruded under the conditions of cylinder temperature of 210° C. and sheet die temperature of 220° C., and cut by sheet-cutting into the polypropylene.

Thickness of Coating Layer of the Detergent Component

Thickness of the coating layer of the detergent component was determined by a surface shape measuring microscope (Keyence, VF-7500) when it was 3μ or more, and by an ellipsometer (Mizojiri Kogaku Kogyosho, DHA-OLX) when it was below 3μ, where the coating layer was irradiated with polarized light, and ellipticity of the reflected light was measured to determine thickness.

Solubility Parameter (SP)

Solubility parameter was determined by the procedure shown in "Adhesives Handbook" (edited by Adhesion Society of Japan, 1980, 2nd. edition, pp. 17).

Washing Effect

When molding of a black-colored resin containing 1% of carbon black was completed by an injection molder having a clamping force of 100 tons, the resin was totally released out of the molder. The molder was then washed with a detergent by a measurement-injection procedure. The quantity of the detergent used was regarded as the washability. The detergent was then replaced by the resin to be molded subsequently. The quantity of the resin used was regarded as the releasability. The washing effect is defined as the sum of washability and releasability.

Production Example 1 (Detergent A)

5.0 kg of a high-density polyethylene granule having an average size of 2.5 mm (averaged longest dimensions) was immersed in silicone oil (SP: 7.3, Toshiba Silicone, TSF451-100) as the detergent component at normal temperature for 3 min. The granule coated with the detergent component was withdrawn from the oil and dried at 30° C. for 1 h, to prepare Detergent A. Thickness of the coating layer of the detergent component over Detergent A was 1μ. The detergent particles having a size of 4.5 mm or more accounted for 4% of the total particles.

Production Example 2 (Detergent B)

5.0 kg of a high-density polyethylene granule having an average size of 3.5 mm was immersed in liquid paraffin (SP: 8.0) as the detergent component at normal temperature for 5 min. The granule coated with the detergent component was withdrawn and dried at 30° C. for 1 h, to prepare Detergent B. Thickness of the coating layer of the detergent component over Detergent B was 30μ. The detergent particles having a size of 5 mm or more accounted for 4% of the total particles.

Production Example 3 (Detergent C)

5.0 kg of a high-density polyethylene granule having an average size of 1.5 mm was immersed in a fluorine-based surfactant (SP: 6.1, Dai-Nippon Ink, F-177) as the detergent component at normal temperature for 3 min. The granule coated with the detergent component was withdrawn and dried at 35° C. for 1 h, to prepare Detergent C. Thickness of the coating layer of the detergent component over Detergent C was 0.3μ. The detergent particles having a size of 2.5 mm or more accounted for 3% of the total particles.

Production Example 4

5.0 kg of a high-density polyethylene granule having an average size of 3.0 mm was immersed in a paraffin-based process oil (SP: 6.6, Mitubishi Oil, P-4) as the detergent component at normal temperature for 10 min. The granule coated with the detergent component was withdrawn and dried at 30° C. for 1 h, to prepare Detergent D. The thickness of the coating layer of the detergent component over Detergent D was 80μ. The detergent particles having a size of 4.0 mm or more accounted for 3% of the total particles.

Production Example 5

5.0 kg of a polypropylene granule having an average size of 2.0 mm was immersed in a fluorine-based surfactant (SP: 6.1) as the detergent component at normal temperature for 5 min. The granule coated with the detergent component was withdrawn and dried at 35° C. for 1 h, to prepare Detergent E. Thickness of the coating layer of the detergent component over Detergent E was 0.2μ. The detergent particles having a size of 3 mm or more accounted for 4% of the total particles.

Production Example 6 (Addition of a third component)

5.0 kg of a high-density polyethylene granule having an average size of 2.5 mm was immersed in silicone oil (SP: 7.3, Toshiba Silicone, TSF451-100) as the detergent component at normal temperature for 2 h. Thickness of the coating layer of the detergent component was 1 μm. The detergent particles having a size of 4.5 mm or more accounted for 4% of the total particles.

3.0 kg of the detergent thus prepared was mixed with basic magnesium 12-hydroxystearate as the third component, to attach 0.05 wt. % of the third component to the detergent (Detergent F).

Production Example 7 (Kneading Method)

5.0 kg of a high-density polyethylene granule (melt index MI=0.35, determined in accordance with JIS K-7210) was mixed with 100 g of silicone oil (Toshiba Silicone, TSF451-100) by a Henschel mixer at 300 rpm for 1 min, and kneaded in molten state by a monoaxial extruder under the conditions of cylinder temperature of 200° C. and die temperature of 210° C. The mixture was then cut by strand-cutting, to prepare resin granule for washing (Detergent (a)).

Production Example 8

5.0 kg of a high-density polyethylene granule having an average size of 5.0 mm was immersed in tri(2-ethylhexyl) phosphate (TOP, SP: 7.9) as the detergent component at normal temperature for 10 min. The granule coated with the detergent component was withdrawn and dried at 35° C. for 1 h, to prepare Detergent (b). Thickness of the coating layer of the detergent component over Detergent (b) was 120μ. The detergent particles having a size of 5.5 mm or more accounted for 7% of the total particles.

Production Example 9

An uncoated high-density polyethylene granule having an average size of 2.5 mm was used as Detergent (c).

Example 1

When molding of 5 kg of black-colored ABS resin was completed, the resin was totally released out of the cylinder. The molder was then washed with the resin granule for washing (Detergent A) prepared by PRODUCTION EXAMPLE 1 by a measurement-injection procedure at 240° C. The quantity of Detergent A used was 400 g (washability). Detergent A was then replaced by transparent PP resin, to confirm that Detergent A was totally released. Washing was effected by a repeated measurement-washing procedure. The quantity of the transparent PP resin used was 160 g (releasability). The washing effect, defined as the sum of washability and releasability, was 560 g.

Example 2

When molding of 5 kg of black-colored ABS resin of flame-retarded grade was completed, the resin was totally released out of the cylinder. The molder was then washed with Detergent A by a measurement-injection procedure at 220° C. The quantity of Detergent A used was 450 g (washability). Detergent A was then replaced by transparent ABS resin, where washing was effected by a repeated measurement-washing procedure. The quantity of the transparent ABS resin used was 200 g (releasability). The washing effect, defined as the sum of washability and releasability, was 650 g.

Example 3

When molding of 5 kg of black-colored PPE resin was completed, the resin was totally released out of the cylinder. The molder was then washed with Detergent A by a measurement-injection procedure at 300° C. The quantity of Detergent A used was 490 g (washability). Detergent A was then replaced by transparent PC resin, to confirm that Detergent A was totally released. Washing was effected by a repeated measurement-washing procedure. The quantity of the PC resin used was 220 g (releasability). The washing effect was 710 g.

Example 4

When molding of 5 kg of black-colored PP resin was completed, the resin was totally released out of the cylinder. The molder was then washed with Detergent A by a measurement-injection procedure at 230° C. The quantity of Detergent A used was 400 g (washability). Detergent A was then replaced by transparent PS resin, to confirm that Detergent A was totally released. Washing was effected by a repeated measurement-washing procedure. The quantity of the PS resin used was 260 g (releasability). The washing effect was 660 g.

Example 5

When molding of 5 kg of black-colored ABS resin was completed, the resin was totally released out of the cylinder. The molder was then washed with the resin granule for washing prepared by PRODUCTION EXAMPLE 2 (Detergent B) by a measurement-injection procedure at 240° C. The quantity of Detergent B used was 450 g (washability). Detergent B was then replaced by transparent PP resin, to confirm that Detergent B was totally released. Washing was effected by a repeated measurement-washing procedure. The quantity of the transparent PP resin used was 200 g (releasability). The washing effect was 650 g.

Example 6

When molding of 5 kg of black-colored ABS resin was completed, the resin was totally released out of the cylinder. The molder was then washed with the resin granule for washing prepared by PRODUCTION Example 3 (Detergent C) by a measurement-injection procedure at 240° C. The quantity of Detergent C used was 390 g (washability). Detergent C was then replaced by transparent PP resin, to confirm that Detergent C was totally released. Washing was effected by a repeated measurement-washing procedure. The quantity of the PP resin used was 150 g (releasability). The washing effect was 540 g.

Example 7

When molding of 5 kg of black-colored ABS resin was completed, the resin was totally released out of the cylinder. The molder was then washed with the resin granule for washing prepared by PRODUCTION EXAMPLE 4 (Detergent D) by a measurement-injection procedure at 240° C. A quantity of Detergent D used was 450 g (washability). Detergent D was then replaced by transparent PP resin, to confirm that Detergent C was totally released. Washing was effected by a repeated measurement-washing procedure. A quantity of the transparent PP resin used was 220 g (releasability). The washing effect was 710 g.

Example 8

When molding of 5 kg of black-colored PP resin was completed, the resin was totally released out of the cylinder. The molder was then washed with the resin granule for washing prepared by PRODUCTION EXAMPLE 5 (Detergent E) by a measurement-injection procedure at 230° C. The quantity of Detergent E used was 350 g (washability). Detergent E was then replaced by transparent PP resin, to confirm that Detergent E was totally released. Washing was effected by a repeated measurement-washing procedure. The quantity of the PP resin used was 130 g (releasability). The washing effect was 480 g.

Example 9

When molding of 5 kg of black-colored PP resin was completed, the resin was totally released out of the cylinder. The molder was then washed with the resin granule for washing prepared by PRODUCTION EXAMPLE 5 (Detergent E) by a measurement-injection procedure at 230° C. A quantity of Detergent E used was 350 g (washability). Detergent E was then replaced by transparent ABS resin, to confirm that Detergent E was totally released. Washing was effected by a repeated measurement-washing procedure. A quantity of the ABS resin used was 180 g (releasability). The washing effect was 530 g.

Example 10

When molding of 5 kg of black-colored, flame-retarded ABS resin was completed, the resin was totally released out of the cylinder. The molder was then washed with the resin granule for washing prepared by PRODUCTION EXAMPLE 6 (Detergent F) by a measurement-injection procedure at 220° C. The quantity of Detergent F used was 370 g (washability). Detergent F was then replaced by transparent ABS resin, to confirm that Detergent F was totally released. Washing was effected by a repeated measurement-washing procedure. The quantity of the ABS resin used was 140 g (releasability). The washing effect was 510 g.

Comparative Example 1

When molding of 5 kg of black-colored PP resin was completed, the resin was totally released out of the cylinder. The molder was then washed with the resin granule for washing prepared by PRODUCTION EXAMPLE 7 (Detergent (a)) by a measurement-injection procedure at 230° C. The quantity of Detergent (a) used was 1050 g (washability). Detergent (a) was then replaced by transparent PS resin, to confirm that Detergent (a) was totally released. Washing was effected by a repeated measurement-washing procedure. The quantity of the PS resin used was 850 g (releasability). The washing effect was 1900 g.

Comparative Example 2

When molding of 5 kg of black-colored, flame-retarded ABS resin was completed, the resin was totally released out of the cylinder. The molder was then washed with the resin granule for washing prepared by PRODUCTION EXAMPLE 8 (Detergent (b)) by a measurement-injection procedure at 220° C. A quantity of Detergent (b) used was 640 g (washability). Detergent (b) was then replaced by transparent ABS resin, to confirm that Detergent (b) was totally released. Washing was effected by a repeated measurement-washing procedure. A quantity of the ABS resin used was 390 g (releasability). The washing effect was 1030 g.

Comparative Example 3

When molding of 5 kg of black-colored, ABS resin was completed, the resin was totally released out of the cylinder. The molder was then washed with the high-density polyethylene granule uncoated with a detergent component (Detergent (c)) by a measurement-injection procedure at 240° C. The result was unsatisfactory, because the black color from the ABS resin did not disappear even when the molder was washed with 2000 g or more of Detergent (c).

TABLE 1

| | | Detergent | | Washability | | Releasability | | |
|---|---|---|---|---|---|---|---|---|
| | Resin to be removed | Types | Coating thickness ($\mu$) | Washing Temperature (° C.) | Quantity of detergent used (g) | Subsequent resin | Quantity of subsequent resin used (g) | Washing Effect (Washabity + Releasability) (g) |
| EXAMPLES | | | | | | | | |
| 1 | ABS | Detergent (A) | 1 | 240 | 400 | PP | 160 | 560 |
| 2 | ABS | Detergent (A) | 1 | 220 | 450 | ABS | 200 | 650 |
| 3 | PPE | Detergent (A) | 1 | 300 | 490 | PC | 220 | 710 |
| 4 | PP | Detergent (A) | 1 | 230 | 400 | PS | 260 | 660 |
| 5 | ABS | Detergent (B) | 30 | 240 | 450 | PP | 200 | 650 |
| 6 | ABS | Detergent (C) | 0.3 | 240 | 390 | PP | 150 | 540 |
| 7 | ABS | Detergent (D) | 80 | 240 | 490 | PP | 220 | 710 |
| 8 | PP | Detergent (E) | 0.2 | 230 | 350 | PP | 130 | 480 |
| 9 | PP | Detergent (F) | 0.2 | 230 | 350 | ABS | 180 | 530 |
| 10 | ABS | Detergent (F) | 1 | 220 | 370 | ABS | 140 | 510 |
| COMPARATIVE EXAMPLES | | | | | | | | |
| 1 | PP | Detergent(a) | — | 230 | 1050 | PS | 850 | 1900 |
| 2 | ABS | Detergent(b) | 120 | 220 | 640 | ABS | 390 | 1030 |
| 3 | ABS | Detergent(c) | 0 | 240 | 2000 | — | — | More than 2000 |

It is apparent, as illustrated by EXAMPLES and COMPARATIVE EXAMPLES, that a notable washing effect is secured by the resin granule with a detergent component thereon in a film of specific thickness, in particular as a coating layer.

EFFECTS OF THE PRESENT INVENTION

Use of the resin granule coated with a detergent component, provided by the present invention, brings a high washing effect, on account of its high washability and releasability, reducing the time for resin switchover and the required quantity of detergent.

The method of the present invention can produce a detergent with a high washing effect by a simple procedure and much reduced quantity of detergent.

What is claimed:

1. A resin granule for washing, comprising a resin granule and a detergent component, wherein the external surface of each particle of said granule is coated with a layer of the detergent component to a thickness of 0.1$\mu$ to 100$\mu$.

2. The resin granule for washing of claim 1, wherein the thickness of the coating layer of said detergent is 0.2$\mu$ to 70$\mu$.

3. The resin granule for washing of claim 1, wherein said detergent component to form a coating layer on the said resin granule is composed of at least one type of compound having a solubility parameter 10 or less.

4. The resin granule for washing of claim 1, which further comprises at least one additional component selected from the group consisting of lubricants, surfactants and surface modifiers.

5. The resin granule for washing of claim 4, wherein said third component is attached to said coating layer of the detergent component.

6. A method for producing a resin granule, for washing, comprising a resin granule and a detergent component, wherein said resin granule is brought into contact with said detergent component for a sufficient time so that the external surface of the former is coated with a layer of the latter to a thickness of 0.1$\mu$ to 100$\mu$, by at least one of the process selected from the group consisting of:

(a) immersion of the resin granule in a solution of the detergent component, (b) spraying a solution of the detergent component onto the resin granule, (c) mixing the resin granule with a solution of the detergent component under no heating and (d) adsorption of the detergent component vapor onto the external surface of the resin granule, and then the resin granule coated with the detergent component is separated.

7. The method for producing a resin granule for washing of claim 6, further including a heating step.

8. A method for washing resin molders which uses a resin granule for washing of claim 1.

* * * * *